US010352096B2

(12) United States Patent
Chen

(10) Patent No.: US 10,352,096 B2
(45) Date of Patent: Jul. 16, 2019

(54) WINDING DEVICE FOR A ROLLER SHADE WITH A SELF-LOCKING FUNCTION TO PREVENT THE ROLLER SHADE FROM INCURRING DETACHMENT DURING REVERSE ROTATION

(71) Applicant: My Home Global Company, ErShui Township, ChangHua County (TW)

(72) Inventor: Ju-Huai Chen, ErShui Township (TW)

(73) Assignee: MY HOME GLOBAL COMPANY (TW)

( * ) Notice: Subject to any disclaimer, the term of this patent is extended or adjusted under 35 U.S.C. 154(b) by 189 days.

(21) Appl. No.: 15/649,760

(22) Filed: Jul. 14, 2017

(65) Prior Publication Data

US 2019/0017321 A1 Jan. 17, 2019

(51) Int. Cl.

| | |
|---|---|
| ***A47H 5/00*** | (2006.01) |
| ***E06B 9/00*** | (2006.01) |
| ***E06B 9/42*** | (2006.01) |
| ***E06B 9/50*** | (2006.01) |
| ***E06B 9/60*** | (2006.01) |
| ***E06B 9/62*** | (2006.01) |
| ***E06B 9/68*** | (2006.01) |
| ***E06B 9/78*** | (2006.01) |
| ***E06B 9/80*** | (2006.01) |

(52) U.S. Cl.

CPC ..... *E06B 9/68* (2013.01); *E06B 9/42* (2013.01); *E06B 9/50* (2013.01); *E06B 9/60* (2013.01); *E06B 9/62* (2013.01); *E06B 9/78* (2013.01); *E06B 9/80* (2013.01); *A47H 5/00* (2013.01); *E06B 9/00* (2013.01)

(58) Field of Classification Search

CPC ..... E06B 9/68; E06B 9/42; E06B 9/62; E06B 9/60; E06B 9/50; E06B 9/78; E06B 9/80; E06B 9/00; A47H 5/00

See application file for complete search history.

(56) References Cited

U.S. PATENT DOCUMENTS 6,029,734 A * 2/2000 Wang ..... E06B 9/322 160/170
6,575,223 B1 * 6/2003 Chung ..... E06B 9/32 160/170

(Continued)

FOREIGN PATENT DOCUMENTS

| | | | |
|---|---|---|---|
| GB | 2555672 | * | 5/2018 |
| JP | 2014-84636 | * | 10/2012 |
| KR | 20110087223 A | * | 8/2011 |

*Primary Examiner* — William A. Rivera

(74) *Attorney, Agent, or Firm* — Alan D. Kamrath Mayer & Williams PC

(57) ABSTRACT

A winding device for a roller shade includes a side bracket (1), a self-locking unit (2) and a return wheel module (3). The self-locking unit is mounted in the side bracket and includes at least one support member (21) and at least one stop member (22). The return wheel module is mounted in the side bracket and includes a return wheel (31), a winder wheel (32) and a volute spiral blade spring (33) stretched between the return wheel and the winder wheel. The volute spiral blade spring has a distal end (331) connected to the winder wheel and is provided with a locking portion (332) that is located at the distal end and is movable to lock the at least one stop member.

10 Claims, 10 Drawing Sheets

(56) References Cited

U.S. PATENT DOCUMENTS

| | | | | |
|---|---|---|---|---|
| 8,708,024 | B2 * | 4/2014 | Toti | E06B 9/322<br>160/170 |
| 10,113,359 | B1 * | 10/2018 | Chen | E06B 9/56 |
| 2011/0036516 | A1 * | 2/2011 | Cheng | E06B 9/60<br>160/311 |
| 2015/0136892 | A1 * | 5/2015 | Hung | E06B 9/322<br>242/397.5 |
| 2017/0260804 | A1 * | 9/2017 | Wu | E06B 9/322 |
| 2017/0350188 | A1 * | 12/2017 | Huang | E06B 9/60 |
| 2019/0017321 | A1 * | 1/2019 | Chen | E06B 9/68 |

* cited by examiner

WINDING DEVICE FOR A ROLLER SHADE WITH A SELF-LOCKING FUNCTION TO PREVENT THE ROLLER SHADE FROM INCURRING DETACHMENT DURING REVERSE ROTATION

BACKGROUND OF THE INVENTION

1. Field of the Invention

The present invention relates to a roller shade and, more particularly, to a winding device for a roller shade.

2. Description of the Related Art

A conventional roman shade comprises a headrail, a shading member mounted on and extended from the headrail, a plurality of transverse rods mounted on the shading member, and a lift cord extended through the shading member and secured to the bottom of the shading member to move the shading member upward and downward. When the lift cord is pulled, the transverse rods are driven and moved to roll or expand the shading member. Thus, the bottom of the shading member is lifted and folded by the lift cord to allow passage of the solar rays and is lowered and expanded by the lift cord to provide a shading effect. However, the lift cord depends from a side of the roman shade so that the lift cord is easily tangled with a child's neck during playing, thereby causing danger to the child. A conventional cordless roller shade comprises a winding mechanism having a shaft and a shade cloth having an upper end secured to the shaft of the winding mechanism. When the winding mechanism is operated, the shaft of the winding mechanism is rotated to move the shade cloth upward or downward so as to wind or unwind the shade cloth. Thus, the shade cloth is wound or unwound by operation of the winding mechanism without needing a pull cord so that the conventional roller shade is operated safely and conveniently.

BRIEF SUMMARY OF THE INVENTION

The primary objective of the present invention is to provide a winding device for a roller shade with a self-locking function to prevent the roller shade from incurring detachment during the reverse rotation.

In accordance with the present invention, there is provided a winding device for a roller shade, comprising a side bracket, a self-locking unit and a return wheel module. The side bracket has an interior provided with a receiving space which is provided with a fixed axle and a through hole. The self-locking unit is mounted in the receiving space and includes at least one support member corresponding to the through hole, and at least one stop member located between the support member and the fixed axle. The return wheel module is mounted in the receiving space and includes a return wheel having a central hole rotatably mounted on the fixed axle, a winder wheel having a central bore rotatably mounted on the at least one support member, and a volute spiral blade spring arranged between the return wheel and the winder wheel. The return wheel has a periphery provided with a first annular groove, and the winder wheel has a periphery provided with a second annular groove. The volute spiral blade spring is wound around the return wheel and has a distal end connected to the winder wheel in a different direction to form a connection, so that the volute spiral blade spring is stretched between the return wheel and the winder wheel. The volute spiral blade spring is provided with a locking portion that is located at the distal end and is movable to lock the at least one stop member.

According to the primary advantage of the present invention, when the volute spiral blade spring is unwound from the winder wheel to reach the position of the distal end of the volute spiral blade spring, the locking portion of the volute spiral blade spring is exactly locked onto the at least one stop member of the self-locking unit to stop a further movement of the volute spiral blade spring, thereby preventing the distal end of the volute spiral blade spring from being detached from the winder wheel during the reverse rotation of the volute spiral blade spring, and thereby preventing the return wheel module from failing.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
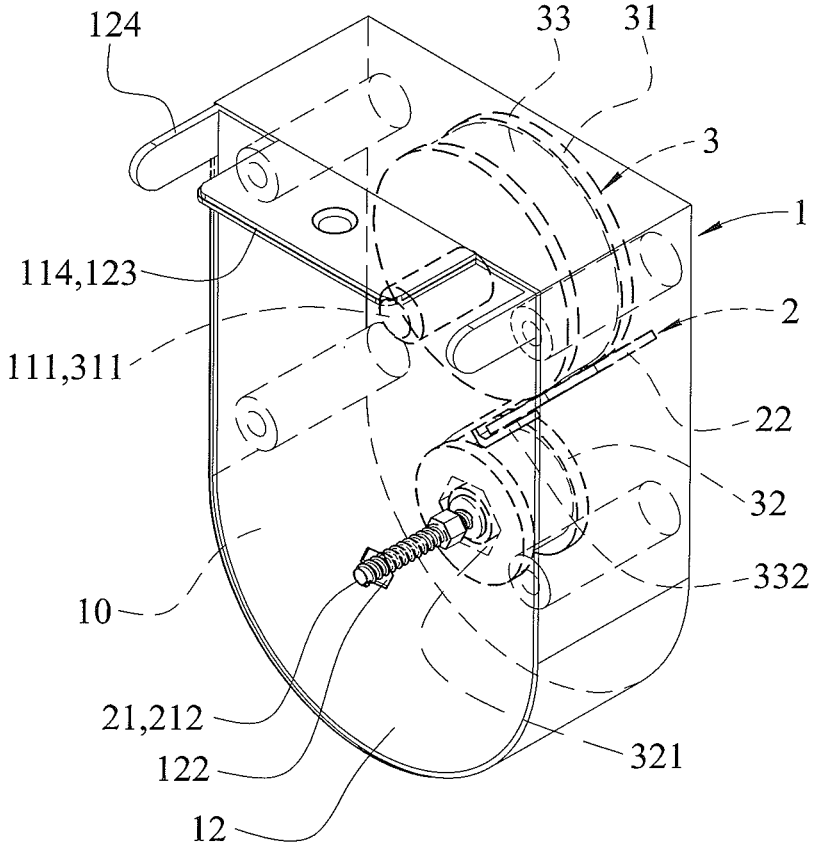
FIG. 1 is a perspective view of a winding device for a roller shade in accordance with the preferred embodiment of the present invention.

Referring to the drawings and initially to FIGS. 1-6, a winding device for a roller shade in accordance with the preferred embodiment of the present invention comprises a side bracket 1, a self-locking unit 2 and a return wheel module 3.

The side bracket 1 has an interior provided with a receiving space 10 which is provided with a fixed axle 111 and a through hole 112.

The self-locking unit 2 is mounted in the receiving space 10 and includes at least one support member 21 corresponding to the through hole 112, and at least one stop member 22 located between the support member 21 and the fixed axle 111.

The return wheel module 3 is mounted in the receiving space 10 and includes a return wheel 31 having a central hole 311 rotatably mounted on the fixed axle 111, a winder wheel 32 having a central bore 321 rotatably mounted on the at least one support member 21, and a volute spiral blade spring 33 arranged between the return wheel 31 and the winder wheel 32. The return wheel 31 has a periphery provided with a first annular groove 312. The winder wheel 32 has a periphery provided with a second annular groove 322. The volute spiral blade spring 33 has a determined rewinding force and is wound around the return wheel 31 at a normal state. The volute spiral blade spring 33 has a distal end 331 connected to the winder wheel 32 in a different direction to form a connection, so that the volute spiral blade spring 33 is stretched between the return wheel 31 and the winder wheel 32. The volute spiral blade spring 33 is provided with a locking portion 332 that is located at the distal end 331 and is movable to lock the at least one stop member 22 to prevent the distal end 331 of the volute spiral blade spring 33 from being detached from the winder wheel 32 during a reverse rotation. A gap is defined between the locking portion 332 and a surface of the volute spiral blade spring 33 to allow insertion of the at least one stop member 22.

In the preferred embodiment of the present invention, the at least one support member 21 has a stepped shape and has a first end provided with a connecting portion 211 secured to the through hole 112 and a second end provided with a threaded rod 212. The central bore 321 of the winder wheel 32 has a stepped shape and has a first end provided with a mounting portion 3211 mounted on the connecting portion 211 of the at least one support member 21 and a second end provided with a positioning portion 3212.

In the preferred embodiment of the present invention, a drive shaft 4 has a fitting end 41 secured in the positioning portion 3212 of the winder wheel 32. The fitting end 41 of the drive shaft 4 and the positioning portion 3212 of the winder wheel 32 have a matching polygonal shape. The fitting end 41 of the drive shaft 4 is provided with a driving hole 411, and the threaded rod 212 is disposed in the driving hole 411.

In the preferred embodiment of the present invention, a washer 23 is mounted on the threaded rod 212 and rests on the connecting portion 211 of the at least one support member 21, and a nut 24 is screwed onto the threaded rod 212 and is secured in the driving hole 411. The nut 24 is rotated by rotation of the drive shaft 4 to move on the threaded rod 212 and is movable to abut the washer 23 which prevents the nut 24 from being jammed with the connecting portion 211 of the at least one support member 21. The nut 24 and the driving hole 411 have a matching polygonal shape.

In the preferred embodiment of the present invention, the connecting portion 211 of the at least one support member 21 is provided with a screw hole 2111, and a fastening member 25 extends through the through hole 112 of the side bracket 1 and is screwed into the screw hole 2111 of the at least one support member 21 to secure the at least one support member 21 to the side bracket 1.

In the preferred embodiment of the present invention, the side bracket 1 includes a housing 11 and a cover 12 combined together. The housing 11 is provided with a plurality of slots 113, and the cover 12 is provided with a plurality of inserts 121 inserted into the slots 113. The cover 12 is further provided with a passage 122 to allow passage of the fitting end 41 of the drive shaft 4, and the threaded rod 212 of the at least one support member 21 protrudes from the passage 122. The passage 122 of the side bracket 1 and the fitting end 41 of the drive shaft 4 have a matching polygonal shape.

In the preferred embodiment of the present invention, the housing 11 is provided with a first locking plate 114, and the cover 12 is provided with a second locking plate 123 and two locking ribs 124. The second locking plate 123 aligns with the first locking plate 114. In assembly, the two locking ribs 124 of the side bracket 1 is inserted into a fixed track of a roller shade. Then, a fastening bolt extends through the first locking plate 114 and the second locking plate 123 and is screwed into the fixed track of the roller shade. Then, the shade cloth of the roller shade is wound around the drive shaft 4. Thus, the drive shaft 4 is rotated to wind or unwind the shade cloth of the roller shade.

Figure 2:
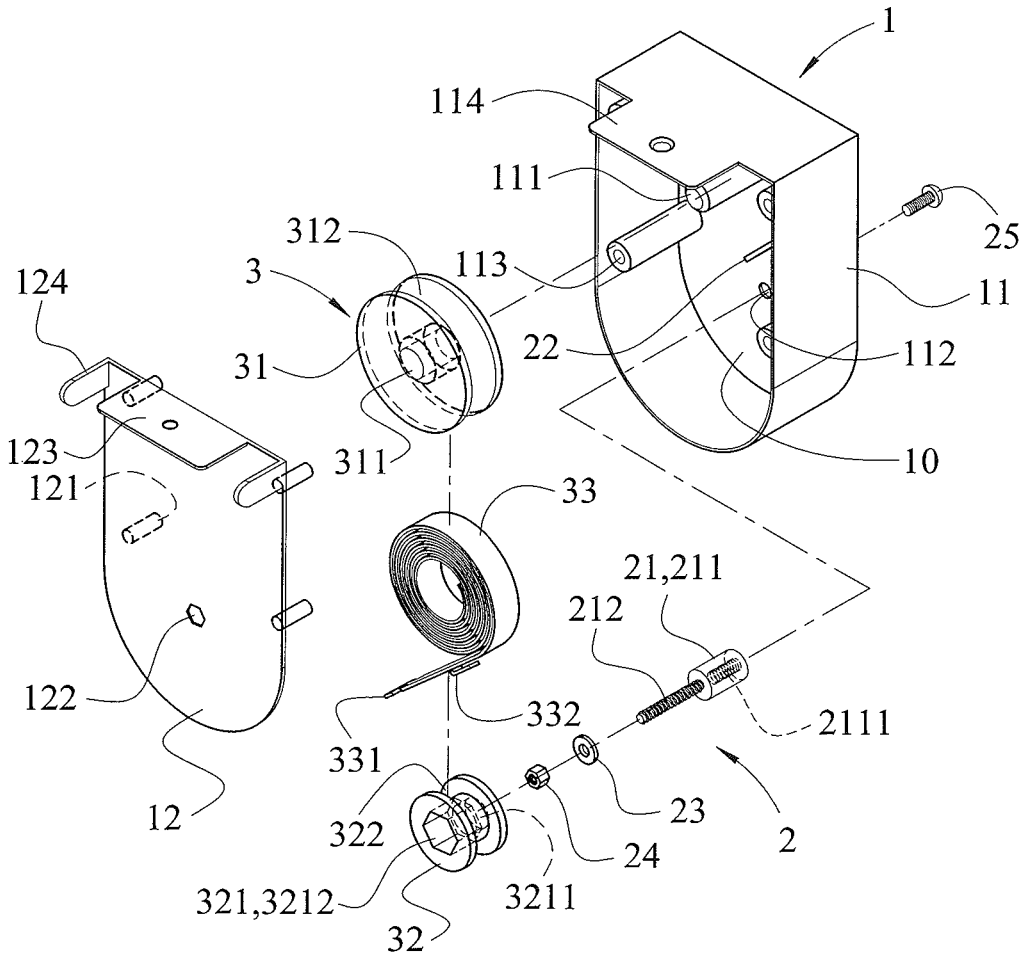
FIG. 2 is an exploded perspective view of the winding device for a roller shade as shown in FIG. 1.
Figure 3:
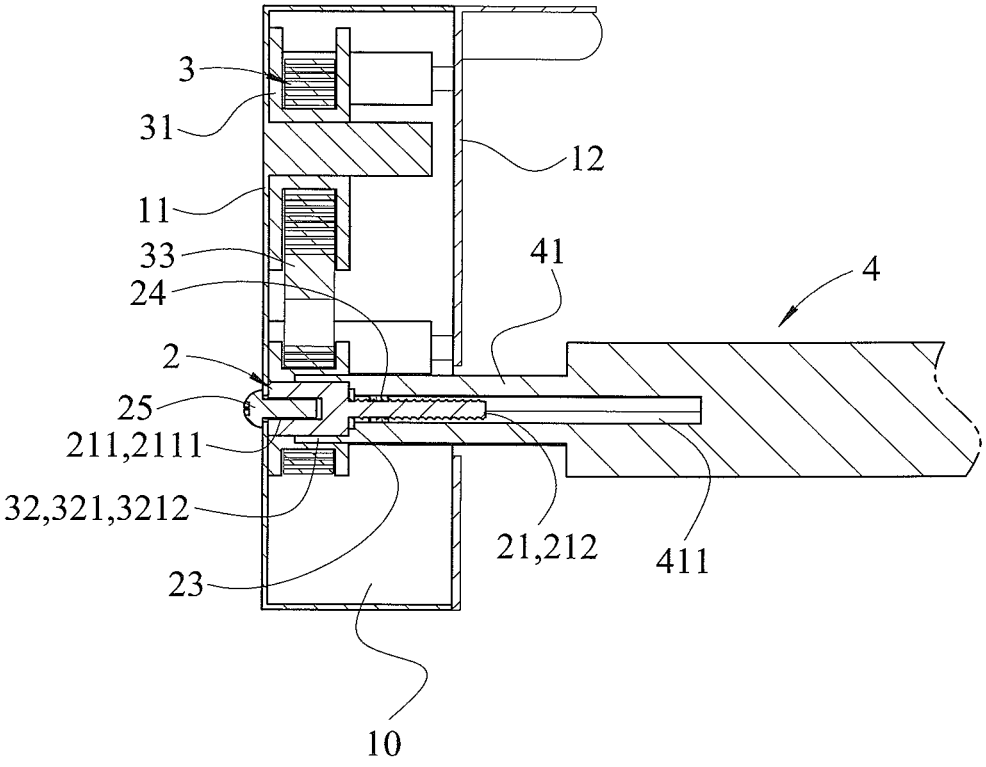
FIG. 3 is a side cross-sectional assembly view of the winding device for a roller shade in accordance with the preferred embodiment of the present invention.
Figure 4:
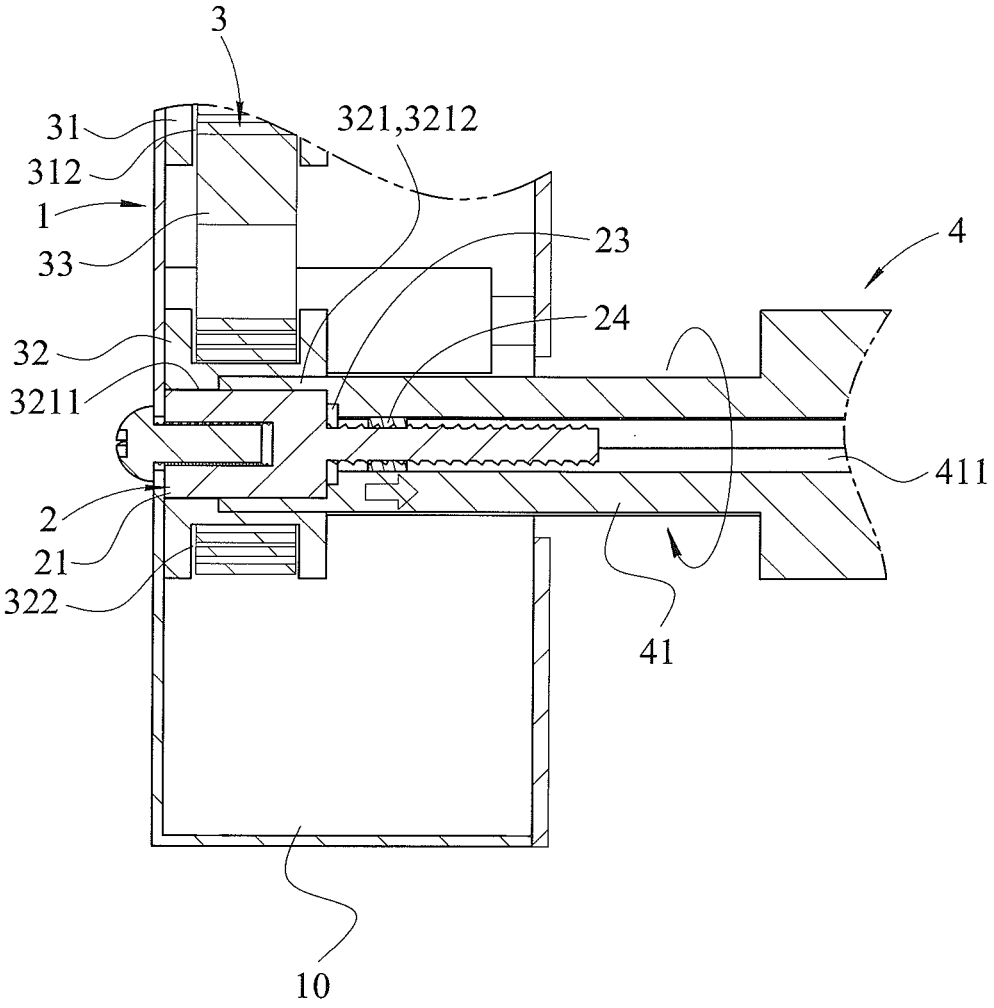
FIG. 4 is a locally enlarged operational view of the winding device for a roller shade as shown in FIG. 3.
Figure 5:
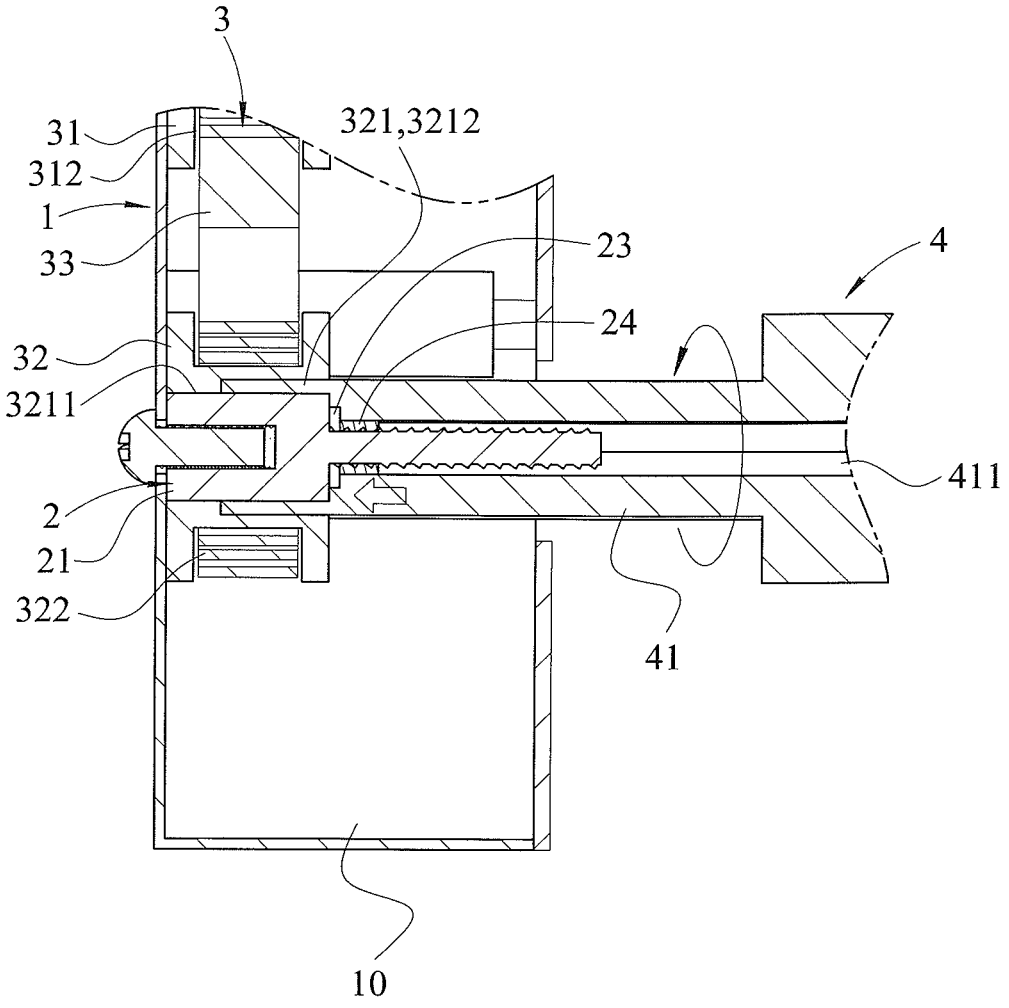
FIG. 5 is another locally enlarged operational view of the winding device for a roller shade as shown in FIG. 3.
Figure 6:
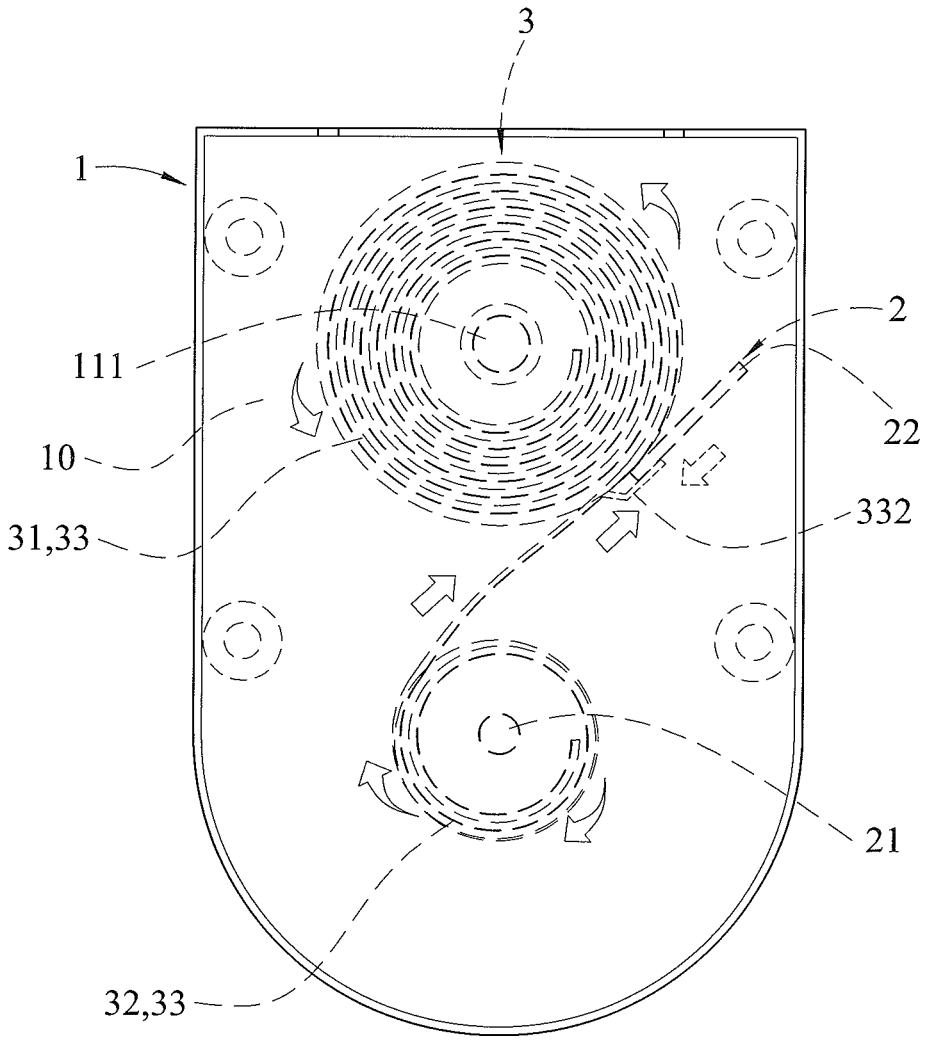
FIG. 6 is a schematic front operational view of the winding device for a roller shade as shown in FIG. 1.

In operation, referring to FIGS. 4-6 with reference to FIGS. 1-3, when the shade cloth of the roller shade is pulled downward and hangs down, the drive shaft 4 is rotated in the normal direction to drive and rotate the winder wheel 32 which drives and moves the volute spiral blade spring 33 which drives and rotates the return wheel 31, so that the winder wheel 32 is rotated anticlockwise and the return wheel 31 is rotated clockwise, while the volute spiral blade spring 33 is unwound from the return wheel 31 and wound around the winder wheel 32 successively. At this time, the nut 24 is secured in the driving hole 411, so that when the drive shaft 4 is rotated, the nut 24 is rotated by the drive shaft 4 to move on the threaded rod 212 and is moved outward as shown in FIG. 4. In such a manner, the nut 24 aids the fitting end 41 of the drive shaft 4 to drive and rotate the winder wheel 32.

On the contrary, when the shade cloth of the roller shade is wound upward, the drive shaft 4 is rotated in the reverse direction to drive and rotate the winder wheel 32 reversely which drives and moves the volute spiral blade spring 33 which drives and rotates the return wheel 31, so that the winder wheel 32 is rotated clockwise and the return wheel 31 is rotated anticlockwise, while the volute spiral blade spring 33 is unwound from the winder wheel 32 and wound around the return wheel 31 successively as shown in FIG. 6. At this time, the volute spiral blade spring 33 is wound around the return wheel 31 automatically by the restoring force of the volute spiral blade spring 33, to aid the reverse rotation of the drive shaft 4. In addition, the nut 24 is secured in the driving hole 411, so that when the drive shaft 4 is rotated, the nut 24 is rotated by the drive shaft 4 to move on the threaded rod 212 and is moved inward to abut the washer 23 as shown in FIG. 5. In such a manner, the washer 23 stops and prevents the nut 24 from being jammed with the connecting portion 211 of the at least one support member 21.

It is appreciated that, when the volute spiral blade spring 33 is unwound from the winder wheel 32 to reach the distal end 331 of the volute spiral blade spring 33, the locking portion 332 of the volute spiral blade spring 33 is locked onto the at least one stop member 22 to stop a further movement of the volute spiral blade spring 33, thereby preventing the distal end 331 of the volute spiral blade spring 33 from being detached from the winder wheel 32 during the reverse rotation of the volute spiral blade spring 33.

As shown in FIG. 6, the at least one stop member 22 is located adjacent to the return wheel 31.

Figure 7:
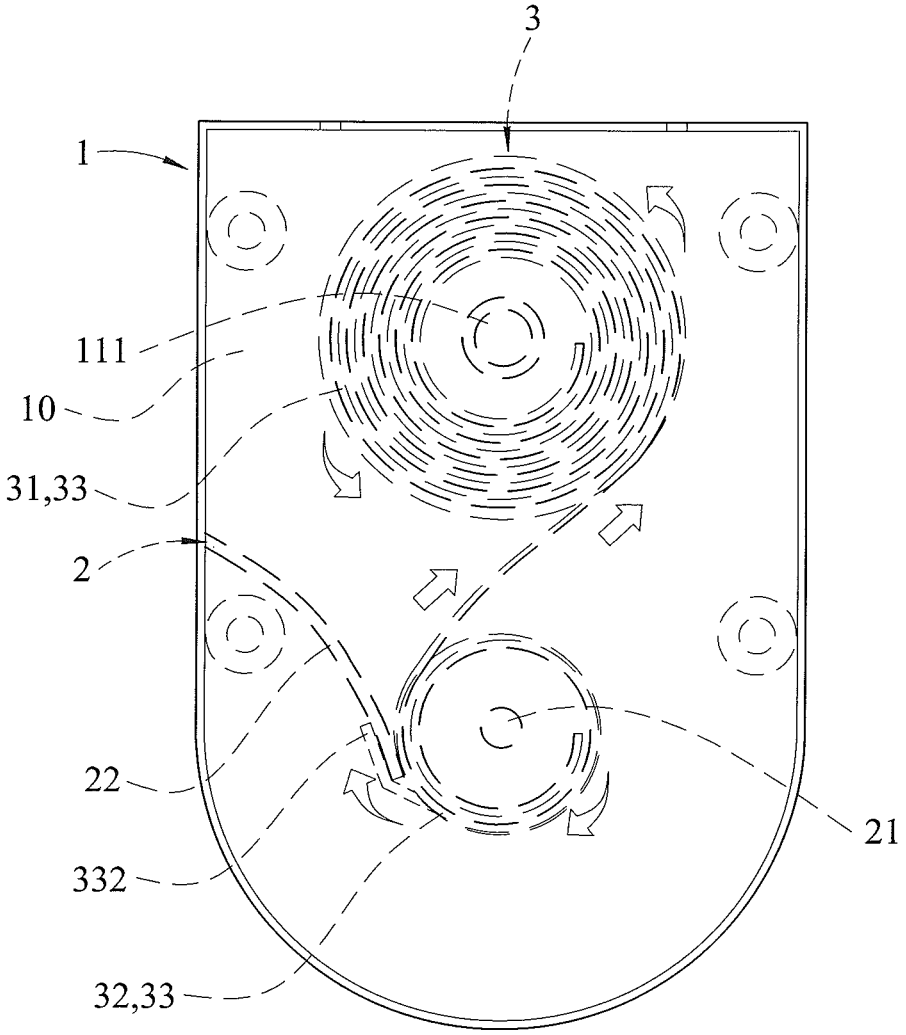
FIG. 7 is a schematic front operational view of the winding device for a roller shade in accordance with another preferred embodiment of the present invention.

As shown in FIG. 7, the at least one stop member 22 is located adjacent to the winder wheel 32.

In another preferred embodiment of the present invention, the return wheel module 3 may include a plurality of return wheels 31, a plurality of winder wheels 32 and a plurality of volute spiral blade springs 33 according to a requirement.

Figure 8:
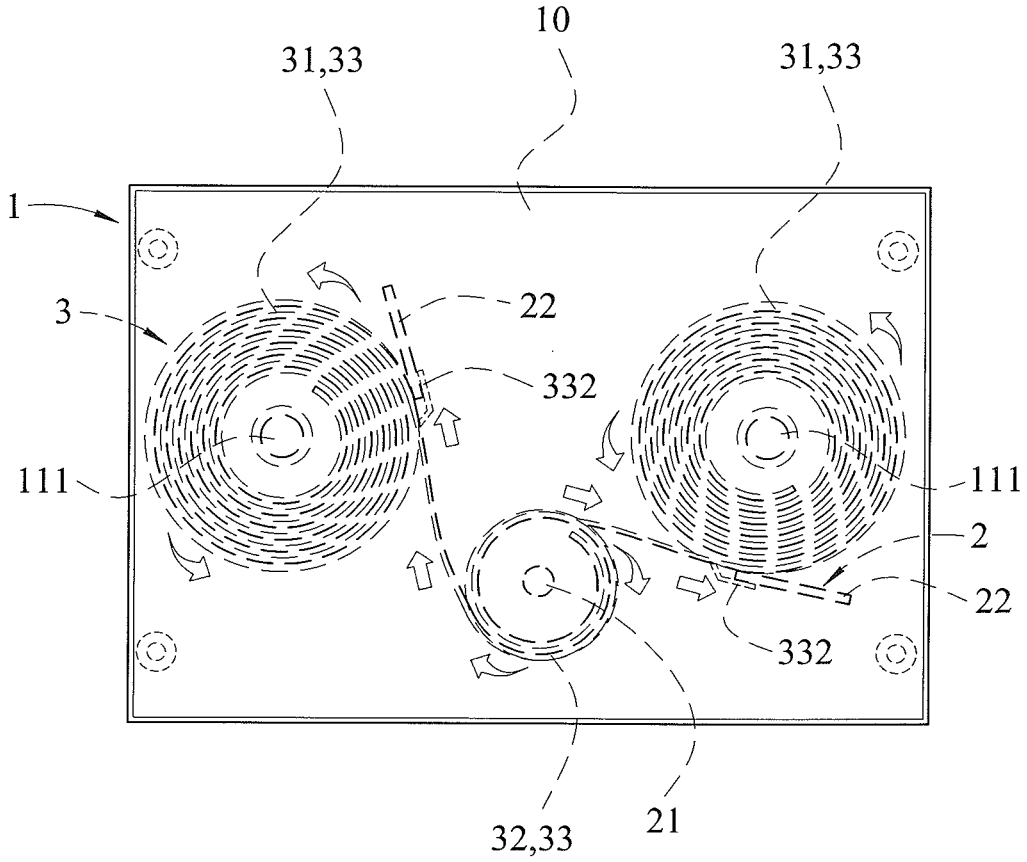
FIG. 8 is a schematic front operational view of the winding device for a roller shade in accordance with another preferred embodiment of the present invention.

Referring to FIG. 8, the return wheel module 3 includes a plurality of return wheels 31, a winder wheel 32, and a plurality of volute spiral blade springs 33 arranged between one of the return wheels 31 and the winder wheel 32. The return wheels 31 are arranged in a transverse manner.

Figure 9:
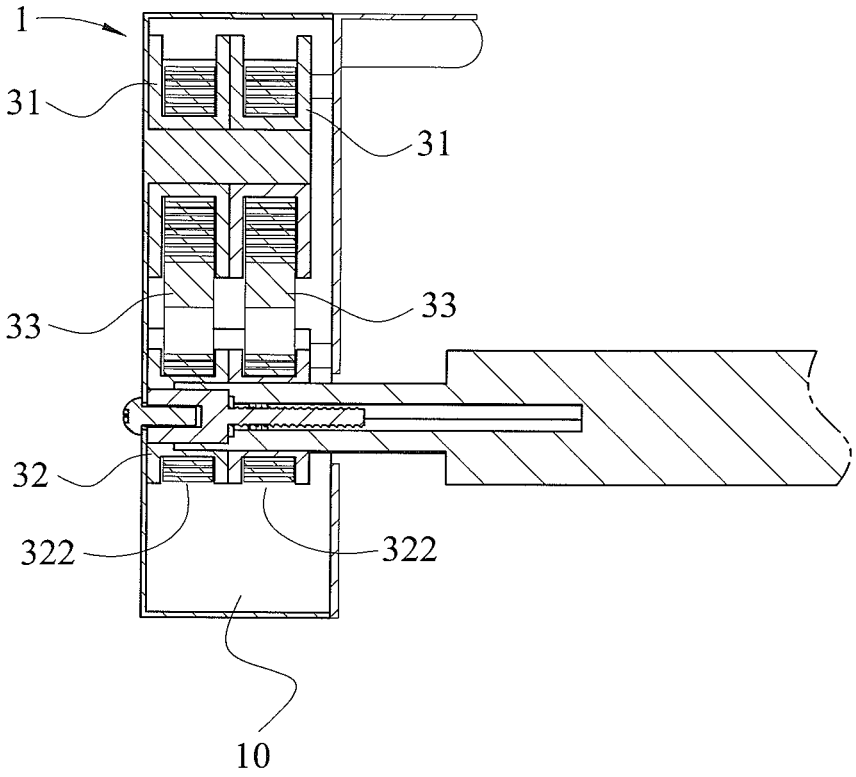
FIG. 9 is a schematic side cross-sectional operational view of the winding device for a roller shade in accordance with another preferred embodiment of the present invention.

Referring to FIG. 9, the return wheel module 3 includes a plurality of return wheels 31, a winder wheel 32, and a plurality of volute spiral blade springs 33 arranged between one of the return wheels 31 and the winder wheel 32. The return wheels 31 are arranged in a stacking manner. The winder wheel 32 has a plurality of second annular grooves 322 for mounting the volute spiral blade springs 33.

Figure 10:
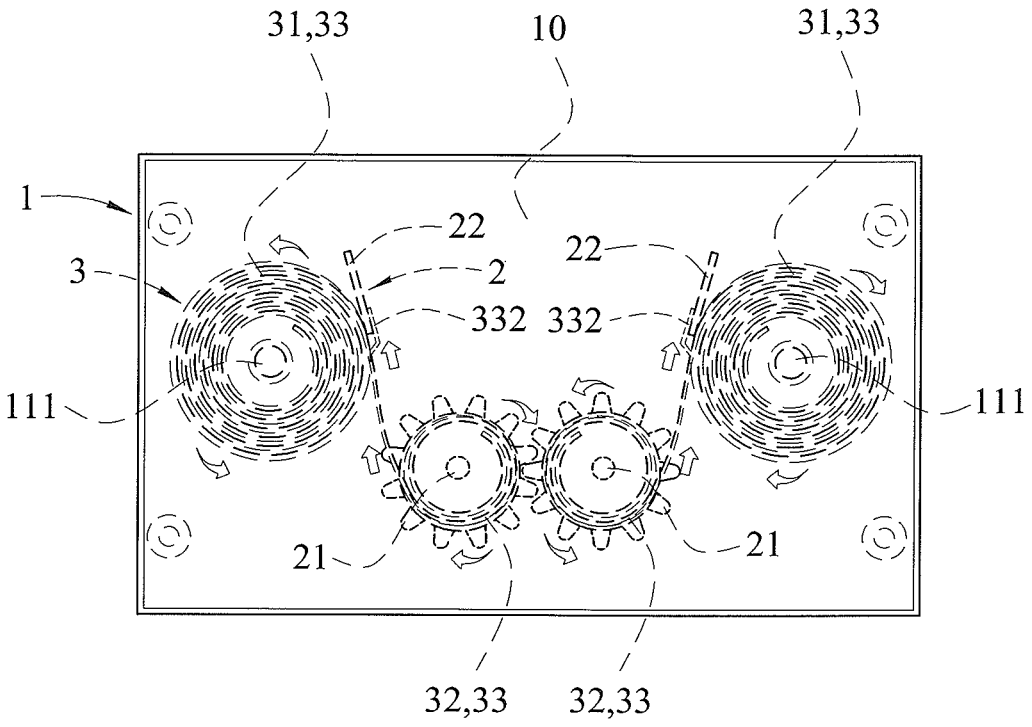
FIG. 10 is a schematic front operational view of the winding device for a roller shade in accordance with another preferred embodiment of the present invention.

Referring to FIG. 10, the return wheel module 3 includes a plurality of return wheels 31, a plurality of winder wheels 32, and a plurality of volute spiral blade springs 33 arranged between the return wheels 31 and the winder wheels 32. The return wheels 31, the winder wheels 32 and the volute spiral blade springs 33 have the same number and are arranged in a transverse manner. The winder wheels 32 have a gear shape and mesh with each other.

Accordingly, when the volute spiral blade spring 33 is unwound from the winder wheel 32 to reach the position of the distal end 331 of the volute spiral blade spring 33, the locking portion 332 of the volute spiral blade spring 33 is exactly locked onto the at least one stop member 22 of the self-locking unit 2 to stop a further movement of the volute spiral blade spring 33, thereby preventing the distal end 331 of the volute spiral blade spring 33 from being detached from the winder wheel 32 during the reverse rotation of the volute spiral blade spring 33, and thereby preventing the return wheel module 3 from failing.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A winding device for a roller shade, comprising:

a side bracket (1), a self-locking unit (2) and a return wheel module (3);

wherein:

the side bracket has an interior provided with a receiving space (10) which is provided with a fixed axle (111) and a through hole (112);

the self-locking unit is mounted in the receiving space and includes at least one support member (21) corresponding to the through hole, and at least one stop member (22) located between the support member and the fixed axle;

the return wheel module is mounted in the receiving space and includes a return wheel (31) having a central hole (311) rotatably mounted on the fixed axle, a winder wheel (32) having a central bore (321) rotatably mounted on the at least one support member, and a volute spiral blade spring (33) arranged between the return wheel and the winder wheel;

the return wheel has a periphery provided with a first annular groove (312);

the winder wheel has a periphery provided with a second annular groove (322);

the volute spiral blade spring is wound around the return wheel and has a distal end (331) connected to the winder wheel in a different direction to form a connection, so that the volute spiral blade spring is stretched between the return wheel and the winder wheel; and the volute spiral blade spring is provided with a locking portion (332) that is located at the distal end and is movable to lock the at least one stop member.

2. The winding device of claim 1, wherein the at least one support member has a stepped shape and has a first end provided with a connecting portion (211) secured to the through hole and a second end provided with a threaded rod (212), and the central bore of the winder wheel has a stepped shape and has a first end provided with a mounting portion (3211) mounted on the connecting portion of the at least one support member and a second end provided with a positioning portion (3212).

3. The winding device of claim 2, wherein a drive shaft (4) has a fitting end (41) secured in the positioning portion of the winder wheel, the fitting end of the drive shaft and the positioning portion of the winder wheel have a matching polygonal shape, the fitting end of the drive shaft is provided with a driving hole (411), and the threaded rod is disposed in the driving hole.

4. The winding device of claim 3, wherein:

a washer (23) is mounted on the threaded rod and rests on the connecting portion of the at least one support member;

a nut (24) is screwed onto the threaded rod and is secured in the driving hole;

the nut is rotated by rotation of the drive shaft to move on the threaded rod and is movable to abut the washer; and the nut and the driving hole have a matching polygonal shape.

5. The winding device of claim 2, wherein the connecting portion of the at least one support member is provided with a screw hole (2111), and a fastening member (25) extends through the through hole of the side bracket and is screwed into the screw hole of the at least one support member.

6. The winding device of claim 5, wherein:

the side bracket includes a housing (11) and a cover (12) combined together;

the housing is provided with a plurality of slots (113);

the cover is provided with a plurality of inserts (121) inserted into the slots;

the cover is further provided with a passage (122) to allow passage of the fitting end of the drive shaft; and the threaded rod of the at least one support member protrudes from the passage.

7. The winding device of claim 1, wherein wheel module may include a plurality of return wheels, a plurality of winder wheels and a plurality of volute spiral blade springs according to a requirement.

8. The winding device of claim 7, wherein:

the return wheel module includes a plurality of return wheels, a winder wheel, and a plurality of volute spiral blade springs arranged between one of the return wheels and the winder wheel; and the return wheels are arranged in a transverse manner.

9. The winding device of claim 7, wherein:

the return wheel module includes a plurality of return wheels, a winder wheel, and a plurality of volute spiral blade springs arranged between one of the return wheels and the winder wheel;

the return wheels are arranged in a stacking manner; and the winder wheel has a periphery provided with a plurality of second annular grooves for mounting the volute spiral blade springs.

10. The winding device of claim 7, wherein:

the return wheel module includes a plurality of return wheels, a plurality of winder wheels, and a plurality of volute spiral blade springs arranged between the return wheels and the winder wheels;

the return wheels, the winder wheels and the volute spiral blade springs have the same number and are arranged in a transverse manner; and the winder wheels have a gear shape and mesh with each other.

* * * * *